US006857765B2

(12) United States Patent
Kameda et al.

(10) Patent No.: US 6,857,765 B2
(45) Date of Patent: Feb. 22, 2005

(54) DECORATIVE LIGHTING EQUIPMENT

(75) Inventors: Masahiro Kameda, Takarazuka (JP); Atsuto Fukushima, Takarazuka (JP); Yoshimitsu Kida, Takarazuka (JP)

(73) Assignee: Kishima, Inc., Hyogo (JP)

( * ) Notice: Subject to any disclaimer, the term of this patent is extended or adjusted under 35 U.S.C. 154(b) by 0 days.

(21) Appl. No.: 10/214,911

(22) Filed: Aug. 7, 2002

(65) Prior Publication Data

US 2003/0174500 A1 Sep. 18, 2003

(30) Foreign Application Priority Data

Mar. 12, 2002 (JP) ..... 2002-067018

(51) Int. Cl.[7] ..... F21V 11/00

(52) U.S. Cl. ..... 362/355; 362/351; 362/356; 362/357; 362/364; 362/186

(58) Field of Search ..... 362/355, 351, 362/356, 357, 364, 186

(56) References Cited

U.S. PATENT DOCUMENTS 3,844,644 A * 10/1974 Martinez ..... 359/443
5,555,162 A * 9/1996 Shemitz ..... 362/225
6,241,363 B1 * 6/2001 Lee ..... 362/231

FOREIGN PATENT DOCUMENTS

| | | |
|---|---|---|
| JP | 07-013025 | 1/1995 |
| JP | 07-159622 | 6/1995 |
| JP | 11-317104 | 11/1999 |
| JP | 3070104 | 4/2000 |
| JP | 2001-076515 | 3/2001 |

* cited by examiner

*Primary Examiner*—Stephen Husar
*Assistant Examiner*—James W Cranson
(74) *Attorney, Agent, or Firm*—Fulbright & Jaworski LLP

(57) ABSTRACT

A decorative lighting equipment includes a shade that is transparent or translucent and formed into a tube with opposite ends, a light source for emitting a directional light flux, the light source being placed at one end of the opposite ends of the shade so that the directional light flux is transmitted within the shade toward another end of the shade, and the shade forming thereon hairlines which extend in a direction crossing the direction along which the directional light flux emitted from the light source is transmitted.

11 Claims, 9 Drawing Sheets

DECORATIVE LIGHTING EQUIPMENT

BACKGROUND OF THE INVENTION

1. Field of the Invention

The present invention relates to a lighting equipment and more particularly a decorative lighting equipment capable of conveying an aesthetic feeling to a user, particularly when used in a dark room with other general lighting equipment such as a fluorescent light and incandescent lamp turned off.

2. Discussion of the Background

A main or inherent purpose of a general lighting equipment such as a room-lighting equipment and table-lighting equipment with a light source such as a fluorescent light and incandescent lamp is to light up a dark room at night or on cloudy day. On the contrary to such a general lighting equipment, some types of a lighting equipment such as an ornamental light frequently used in a restaurant, coffeehouse, bar, etc., is used to create a specific atmosphere by intentionally darkening a room by employing a weak or colored light source, or providing a stained-glass like shade.

The decorative lighting equipment of the above type is not intended to be used to achieve merely an inherent purpose to light up a dark room, but is used to create a specific atmosphere in an intentionally darkened room with room lamps or any other general lighting equipment turned off. Although these types of decorative lighting equipment has been continuously modified, a conventionally applied modification is limited to coloring a light source, using a weak light source and the like, hence creating a limited decorative effect or conveying a limited aesthetic feeling to the user.

As another type of a decorative lighting equipment, lighting equipment used in a stage or hall exists. The lighting equipment of this type has plural light emitting portions, which are rotated while allowing light from a light source to be changed in color and emitted in every direction. Such a stage lighting equipment can create an attractive atmosphere for stage, but is not suitable for a room as mentioned above, which requires a serene, domestic or warm atmosphere.

In view of the foregoing, it is an object of the present invention to provide a new decorative lighting equipment that is capable of creating a special light appearance, which cannot be created by a conventional lighting equipment, which employs a weak light source, colored light source or the like, thereby creating a special atmosphere in a restaurant, coffeehouse, bar, etc., and hence conveying an aesthetic feeling to the user.

SUMMARY OF THE INVENTION

According to the present invention, there is provided a decorative lighting equipment including a shade that is transparent or translucent and formed into a tube with opposite ends, a light source for emitting a directional light flux, the light source being placed at one end of the opposite ends of the shade so that the directional light flux is transmitted within the shade toward another end of the shade, and the shade forming thereon hairlines which extend in a direction crossing the direction along which the directional light flux emitted from the light source is transmitted.

As used throughout the description, the terms "tube" and "tubular" relative to the shape of the shade is meant as any hollow cylindrical shapes, and therefore is not limited to the tube or tubular shape, which has necessarily has opposite ends open. Hence, the tube with the opposite ends closed or either end closed will be still referred as "tube" or "tubular", provided that any related limitation has not been made.

With the decorative lighting equipment having the above arrangement, the directional light flux emitted from the light source placed at the one end of the shade is transmitted to the opposite end within the shade. This light flux is distorted by the hairlines formed on the shade, so that a light appearance is seen as if it converges to a point as advancing to the opposite end of the shade when seen through the shade. As a result, a unique decorative effect can be produced.

Although a varying type of the light source may be employed, it is preferable to use a light-emitting diode since it can emit a light flux having a relatively high directivity.

A light flux emitted from the light source and transmitted within the shade can be seen as if it converges to a point when seen through the shade.

Since a light-emitting diode can emit a light flux in varying color such as red, blue, yellow or green, it is advantageous in producing a decorative effect.

When plural light-emitting diodes are placed at different points (e.g., 8 points) within the shade in a circular fashion, such a light appearance of the light flux, which can be seen as if it converges to a point when seen through the shade can be more effectively displayed.

The shade is not necessarily limited to a specific shape. However, the shade formed into a circular tube allows such a light appearance of the light flux to be more effectively displayed.

The hairlines formed on the shade may extend in a direction crossing at right angle to the direction along which the directional light flux emitted from the light source is transmitted. This directional relationship between the hairlines and the directional light flux can enhance an visual effect of the light appearance, which can be seen as if it converges to a point when seen through the shade.

The shade may be placed in a vertical, horizontal or any other orientation. Also, two or more light sources in the same color or different colors may be provided respectively at the opposite ends of the shade. This light source arrangement may become more effective when the shade is placed in a horizontal orientation.

The thus arranged decorative lighting equipment of the present invention can create an aesthetic atmosphere or produce a decorative effect, thus conveying an aesthetic feeling to a user. Particularly, if it is used in a dark room with other general lighting equipment such as a fluorescent light and incandescent lamp turned off, the decorative effect can be more effectively displayed.

Thus, the decorative lighting equipment of the present invention can be broadly used in a restaurant, coffeehouse, bar, etc., thus producing a practical advantage.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Embodiment 1

Figure 1:
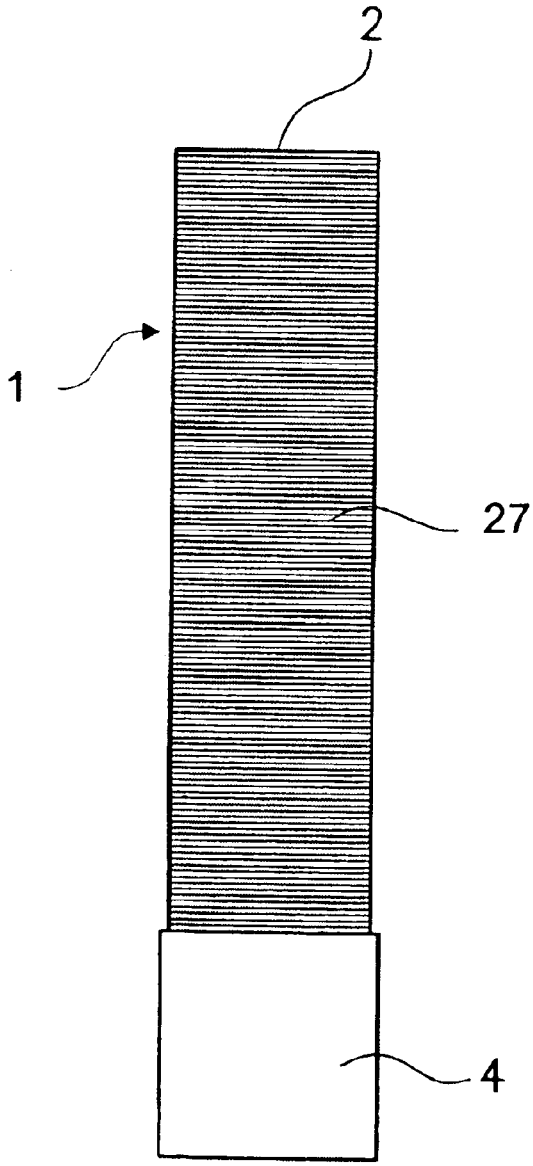
FIG. 1 is a front view illustrating a decorative lighting equipment according to a first embodiment of the present invention.
Figure 2:
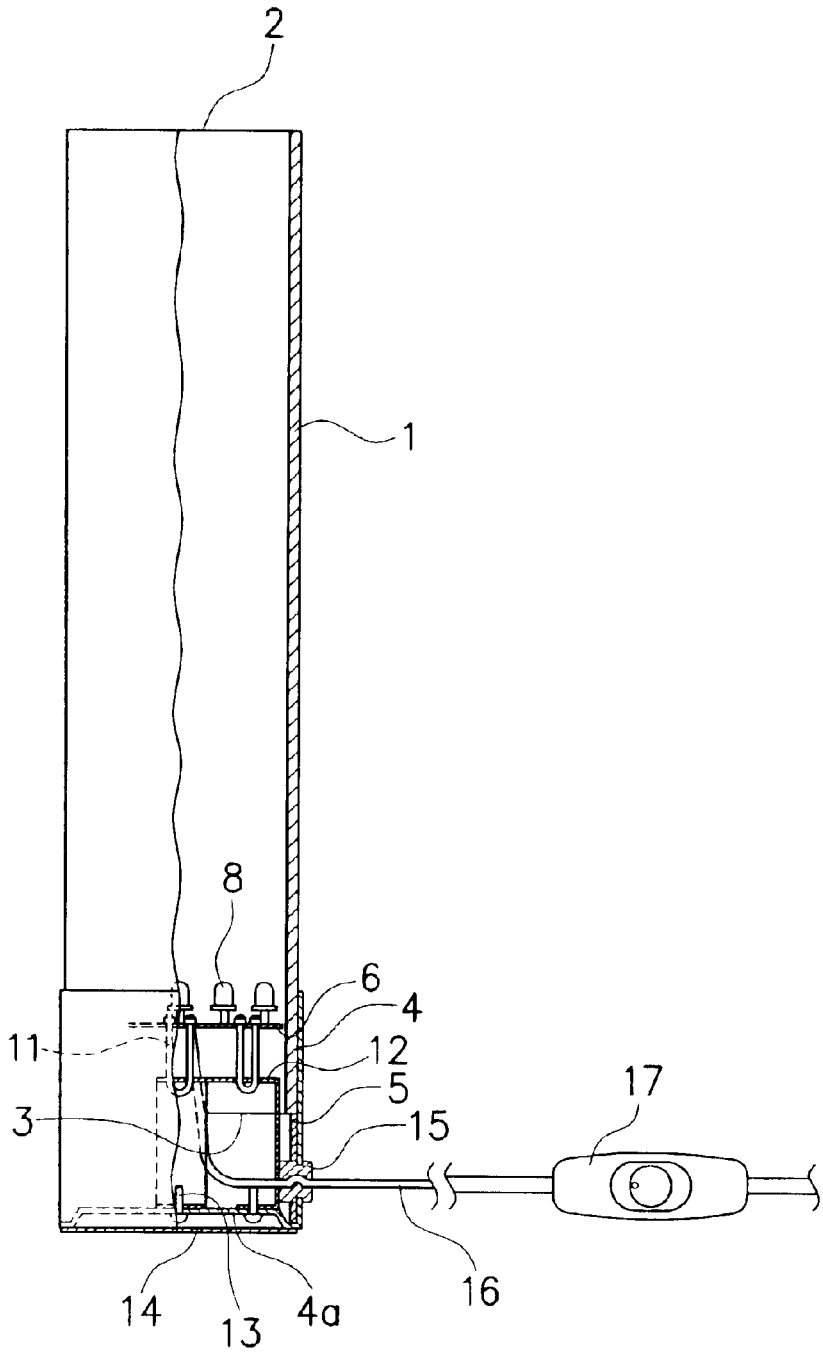
FIG. 2 is a partially sectioned front view of the decorative lighting equipment of the first embodiment.

The decorative lighting equipment of this embodiment includes shade 1 fanned into a substantially circular tube, as illustrated in FIGS. 1 and 2. This shade 1 is overall transparent and made of acrylic resin. This shade 1 forms thereon a large number of hairlines 27 with thin scratch-like pattern, which extend in the circumferential direction of the shade 1, thus crossing substantially at right angle to the axial direction of the shade 1. The formation of these hairlines renders the shade 1 translucent in appearance. It is to be noted that a translucent shade can be used provided that the shade can maintain its translucency even after it is provided with the hairlines.

The shade 1 has a top end and bottom end respectively defining upper opening 2 and lower opening 3. The upper opening 2 is positioned at the top of the equipment and remains open, while the bottom end is placed in the inside of shade holding body 4 with the lower opening 3 covered by the body 4.

Placed inside of the shade holding body 4 is pedestal 5 having a height substantially half of the shade holding body 4 and an upper end contacting the bottom end of the shade 1. That is, the pedestal 5 has an outer diameter substantially equal to the outer diameter of the shade 1, so that the shade 1 can be supported with its bottom end contacting the pedestal 5.

The shade holding body 4 thus having an outer diameter larger than the outer diameter of each of the shade 1 and the pedestal 5 has an inner diameter substantially equal to the outer diameter of each of the shade 1 and the pedestal 5, so that the outer circumferences of the shade 1 and the pedestal 5 contact the inner circumference of the shade holding body 4, thereby allowing the shade 1 to be securely held by the shade holding body 4.

Figure 3:
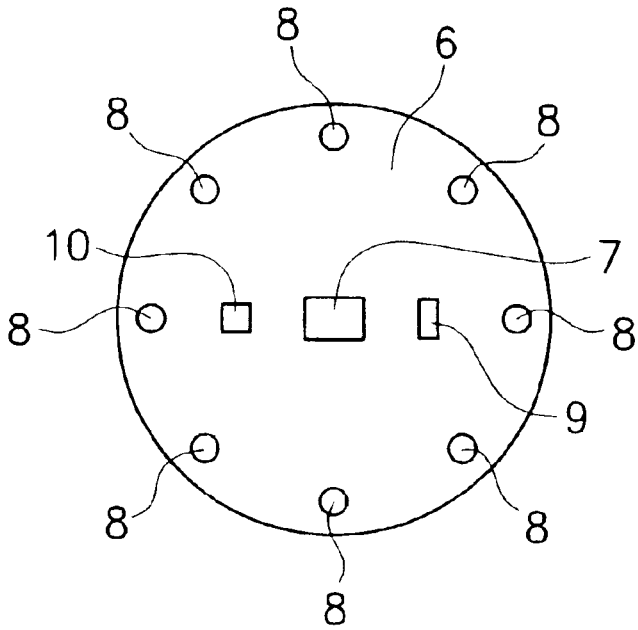
FIG. 3 is a schematic view illustrating the decorative lighting equipment with light-emitting diodes disposed on a base plate.

Referring to FIG. 2, base plate 6 with an IC, light-emitting diodes, etc., disposed thereon is fitted into the lower side of the shade 1. The base plate 6 is provided at its substantially center with rectifying circuit device 7 having an IC, as illustrated in FIG. 3. Light-emitting diodes 8 are mounted at eight places on an inner side of the base plate 6 closer to the peripheral edge thereof, with substantially equal spacing. For these light-emitting diodes 8 together acting as a light source of the equipment, blue-light-emitting diodes made of GaN (gallium nitride) are employed in this embodiment. Resistive element 9 acting as an electric resistance part is mounted substantially at a middle point between one of the blue-light-emitting diodes 8 and the rectifying circuit device 7 on the base plate 6 (right hand side in FIG. 3), while fuse 10 is mounted substantially at a middle point between an opposite one of the blue-light-emitting diodes 8 and the rectifying circuit device 7 (left hand side in FIG. 3).

This base plate 6 is mounted via supporting pipes 11 to base plate mounting member 12, which is in turn mounted on base part 4*a* of the shade holding body 4 via screws 13.

On the rear side of the base part 4*a* of the shade holding body 4 is mounted felt 14 for preventing the lighting equipment from damaging a surface of a portion on which the lighting equipment is placed.

Electric code 16 connected with the lighting equipment at its one end extends to the outside through code stopper 15 provided in a side wall of the shade holding body 4 for preventing an axial displacement of the code 16. The electric code 16 is also provided with intermediate switch 17.

The thus arranged decorative lighting equipment is operated by bringing the intermediate switch 17 into ON-state and OFF-state.

Figure 4:
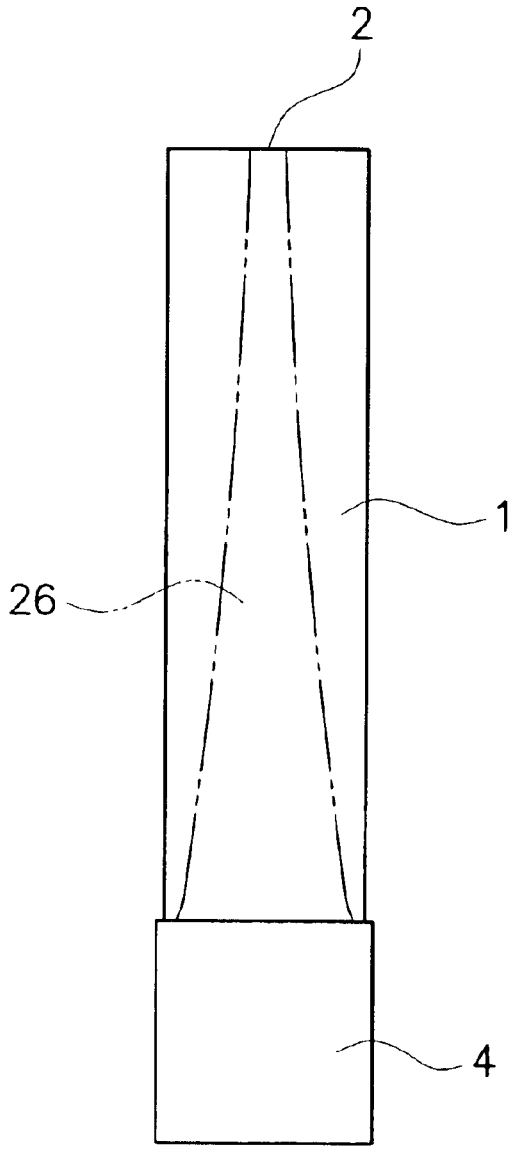
FIG. 4 is a schematic front view illustrating a light emitting direction in accordance with the first embodiment.

Specifically, by bringing the intermediate switch 17 into the ON-state, the power is turned on, enabling the light-emitting diodes 8 as the light source to be lit up. The light-emitting diodes 8 each emit a directional light flux, which is transmitted through the shade 1 in the direction parallel to the axis of the shade 1 and crossing substantially at right angle to the hairlines formed on the shade 1 in the circumferential direction thereof. The light fluxes by those light-emitting diodes 8 extending parallel to the axis of the shade 1 create light appearance 26, which can be seen as if it converges to a point, as illustrated by chain line in FIG. 4, when it is seen through the shade, on which the large number of the hairlines are formed. That is, the hairlines formed on the shade distort the light fluxes in such a manner as to be able to be seen as if they converge to a point.

Since the light-emitting diodes 8 emit blue lights, which together create a light appearance in blue, which sharply emerges particularly when lit up in a dark room with other lights such as a fluorescent light and incandescent lamp turned off. As a result, a unique, aesthetic atmosphere can be created.

Embodiment 2

Figure 5:
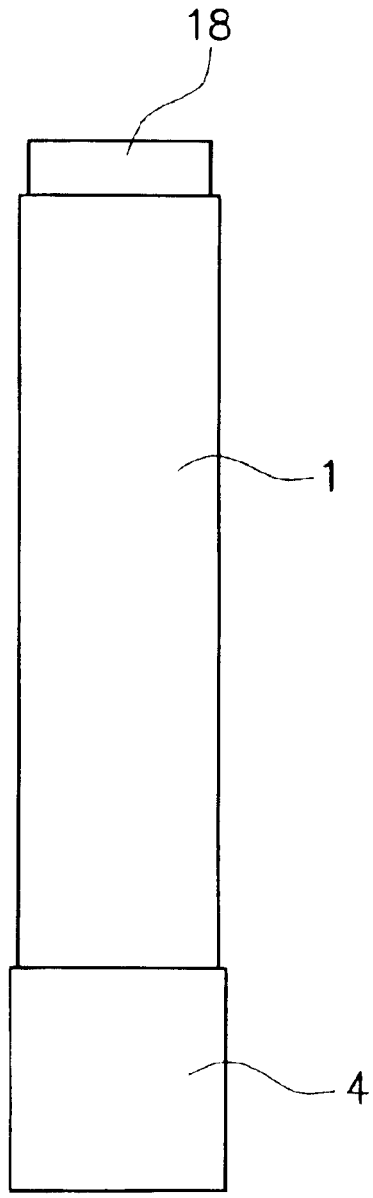
FIG. 5 is a front view illustrating the decorative lighting equipment according to a second embodiment of the present invention.
Figure 6:
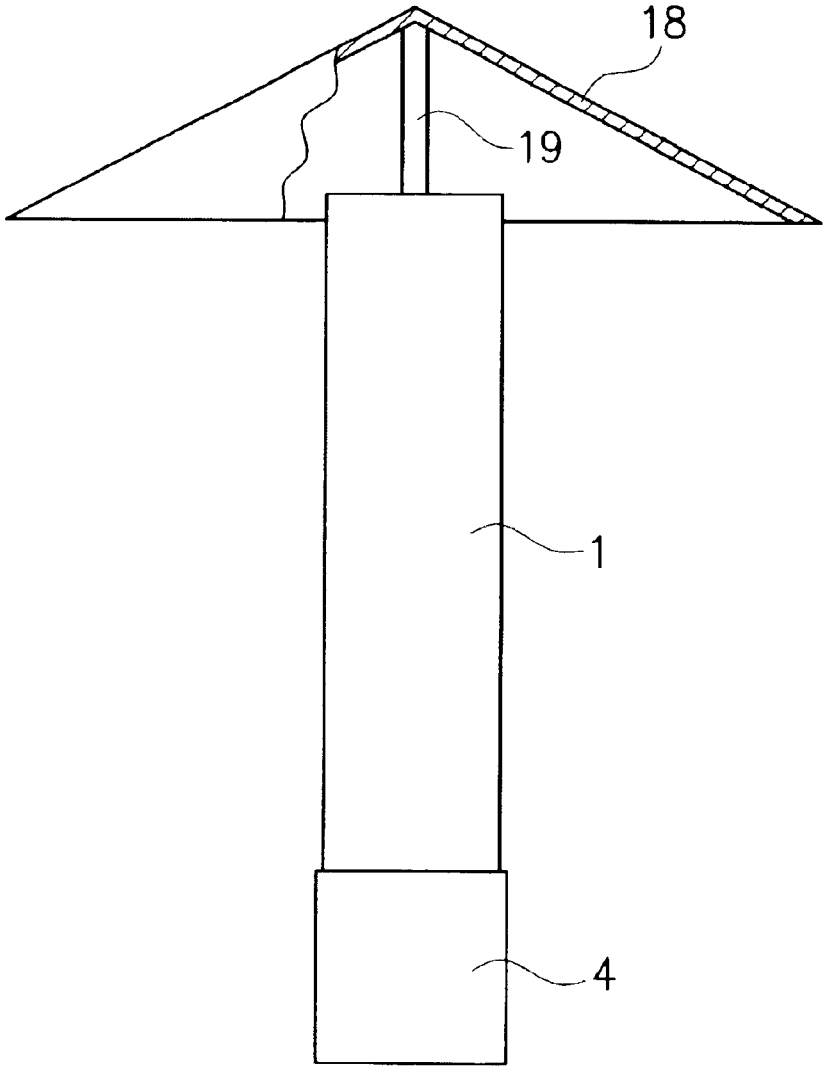
FIG. 6 is a partially sectioned front view illustrating the decorative lighting equipment according to a third embodiment of the present invention.

On the upper opening 2 of the shade 1 is provided decorative design applied plate 18, which projects pictorial images, geometrical patterns or any other shapes on an object surface, as illustrated in FIG. 5. Specifically, the decorative design applied plate 18 is made of a transparent acrylic resin with such pictorial images, geometrical patterns or any other shapes engraved or depicted thereon. The light fluxes emitted from the light-emitting diodes 8 pass through the decorative design applied plate 18, thereby projecting such the image on the ceiling or any other places in the room. Alternatively, a screen may be provided on the ceiling so that the image is projected thereon.

According to this embodiment, in addition to an aesthetic atmosphere created by the light appearance 26 of the light fluxes in blue, which is seen as if it converges to a point when it is seen through the shade 1, an additional aesthetic atmosphere can be created by the pictorial images, geometrical patterns or the like projected on the ceiling or any other places by the blue light fluxes, which are emitted from the light-emitting diodes 8 and pass the decorative design applied plate 18.

Since the shape and material of the shade 1, hairline formation, inside structure of the shade holding body 4 are the same as those of the first embodiment, the detailed description thereof are omitted.

Embodiment 3

In this embodiment, the shade 1 is provided at its upper side with upper shade 18, which radially and downwardly extends, forming a circular convex, is mounted on an upper end of shaft 19 provided along the axis of the shade 1. The upper shade 18 is made of transparent acrylic resin and has a lower surface stained in silver or any other color.

In this embodiment, the blue light fluxes emitted from the light-emitting diodes 8 converge as advancing upward, creating a unique light appearance in blue, and are reflected on the circular convex of the upper shade 18 and then dispersed to the proximity of the upper shade 18 in blurred fashion. Thus dispersed blurred light fluxes create a unique, aesthetic atmosphere in conjunction with the light appearance seen through the shade 1.

Since the shape and material of the shade 1, hairline formation, inside structure of the shade holding body 4 are the same as those of the first embodiment, the detailed description thereof are omitted.

Embodiment 4

Figure 7:
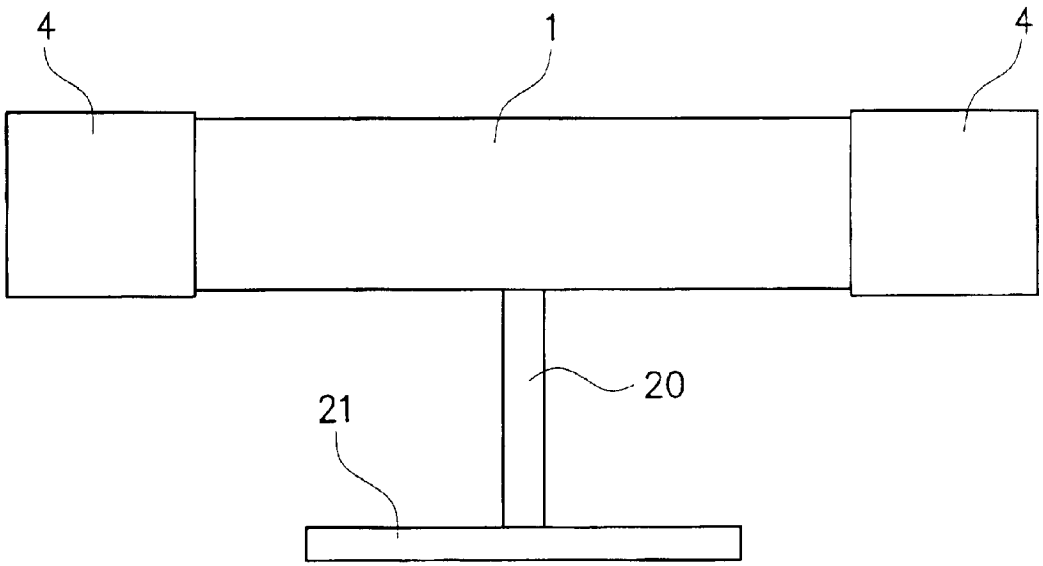
FIG. 7 is a front view illustrating the decorative lighting equipment according to a fourth embodiment of the present invention.

In this embodiment, the shade 1 is placed in a horizontal orientation, as illustrated in FIG. 7, in which first and second shade holding bodies 4, which respectively accommodate base plates 6 with the light-emitting diodes 8 mounted thereon are mounted to the opposite ends of the shade 1.

The light-emitting diodes 8 mounted on the base plate 6 of the first shade body 4 are blue-light-emitting diodes, while the light-emitting diodes 8 mounted on the base plate 6 of the second shade body 4 are red-light-emitting diodes. The shade 1 is mounted on supporting rod 20 vertically extending from base 21.

Since the shape and material of the shade 1, hairline formation, inside structure of the shade holding body 4 are the same as those of the first embodiment, the detailed description thereof will be omitted.

In this embodiment, the blue lights emitted from the light-emitting diodes 8 provided in the first shade holding body 4 is mingled with the red lights emitted from the light-emitting diodes 8 provided in the second shade holding body 4 substantially at the center between the opposite ends of the shade 1, creating a violet light appearance therearound.

Embodiment 5

Figure 8:
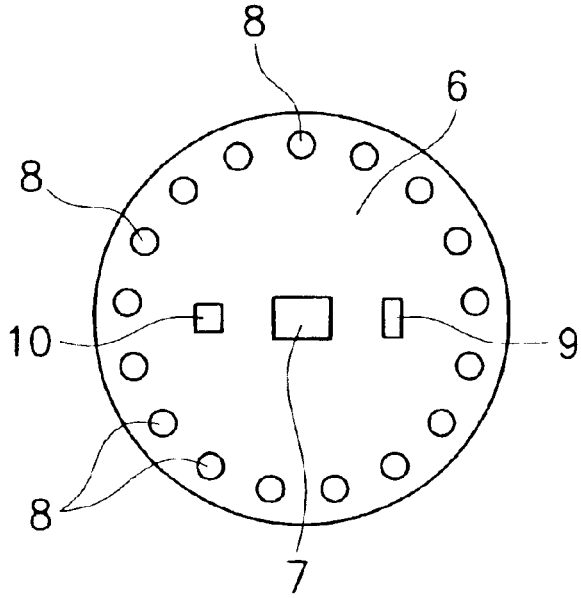
FIG. 8 is a schematic view illustrating light-emitting diodes disposed on a base plate of the decorative lighting equipment according to a fifth embodiment of the present invention.

In this embodiment, the base plate 6 is provided thereon with 16 light-emitting diodes 8 in total, as illustrated in FIG. 8. Of the 16 light-emitting diodes 8, eight diodes are blue-light-emitting diodes, and the residual 8 diodes are red-light-emitting diodes. These blue and red-light-emitting diodes (16 in total) are alternately arranged with substantially equal spacing along the peripheral edge of the base plate 6 in a circular fashion. The red-light-emitting diodes in this embodiment are made of GaP (gallium phosphide).

Since the shape and material of the shade 1, hairline formation, inside structure of the shade holding body 4 are the same as those of the first embodiment, the detailed description thereof will be omitted.

According to the thus arranged lighting equipment, timing of sending electric signals is set in advance by the IC provided on the base plate 6 so that the blue and red-light-emitting diodes are alternately lit up. Specifically, the blue-light-emitting diodes are turned on while the red-light-emitting diodes are turned off, or vice versa according to the controlled electric signals. Thus, light fluxes in two colors can be alternately emitted from a single light source.

Embodiment 6

Figure 9:
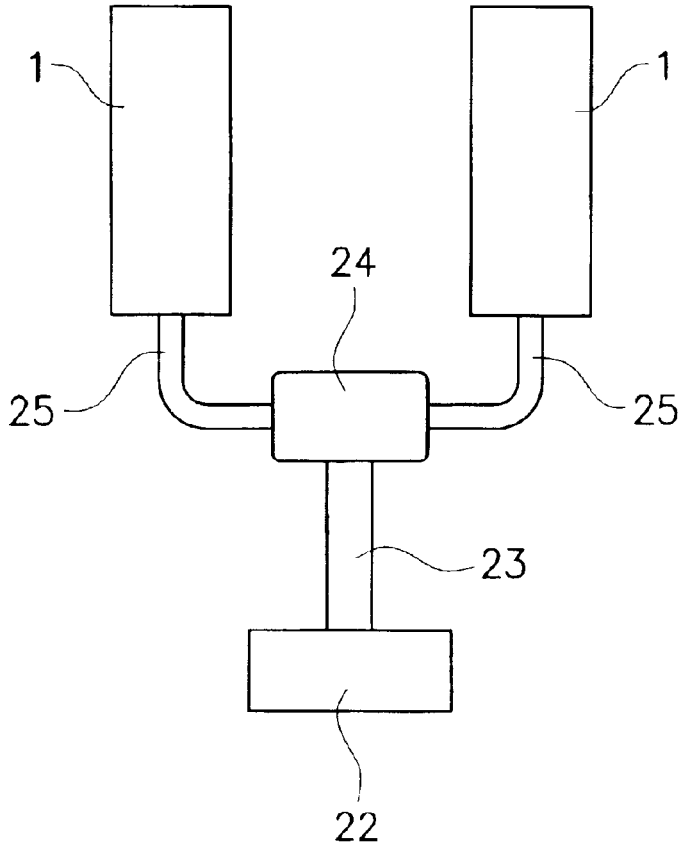
FIG. 9 is a front view illustrating the decorative lighting equipment according to a sixth embodiment of the present invention.

In this embodiment, the decorative lighting equipment is of a self-stand type provided with two shades 1 extending parallel to each other at the lateral sides, as illustrated in FIG. 9.

Specifically, the lighting equipment of this embodiment includes base 22, upright post 23 extending from the base 22, base member 24 provided on the upright post 23, a pair of supporting arms 25 respectively having substantially L-shapes oppositely extending from the base member 24, and the shades 1 respectively mounted to the supporting arms 25.

Since the shape and material of each shade 1, hairline formation, inside structure of the shade holding body 4, and the like are the same as those of the first embodiment, the detailed description thereof will be omitted.

As will be appreciated, the lighting equipment of this embodiment creates two light appearances, each being seen as if it converges to a point as advancing upward when seen through a corresponding shade 1. Thus, it produces an excellent decorative effect as an interior product.

Other Embodiments

In the foregoing embodiments, the shade 1 is formed into a circular tube. However, the shade 1 is not limited to this shape. For example, the shade 1 can be formed into a square, triangular or any other angular or rounded tube. However, the shade 1 formed into a circular tube is most preferable since it allows the lights converging as advancing within the shade 1 to be most effectively displayed.

In the foregoing embodiments, the shade 1 is formed into a tube with the opposite ends open. However, the tube or tubular shape is not limited to such a shape. It is a matter of course that the shade formed into a tube with either end or both ends closed can be used.

The material of the shade 1 is not also limited to acrylic resin. Glass or any other materials may be employed, provided that the shade with the hairlines formed thereon allows a light appearance to be seen through the shade from the outside.

The transparency or translucency of the shade 1 is also not essential, as far as the shade 1 allows a light appearance to be seen from the outside through the shade 1.

The blue-light-emitting diodes are used for diodes 8 in the embodiments 1–3, while the red-light-emitting diodes are used for diodes 8 in the embodiments 4 and 5. However, the color of the light is not necessarily limited to these embodiments. It is possible to employ a light-emitting diode that can emit a light in a different color such as orange, yellow and green.

In the foregoing embodiments, the 8 light-emitting diodes disposed on the base plate 6 are arranged so as to be simultaneously turned on and off. However, the simultaneously turning on and off of the diodes is not essential. The 8 light-emitting diodes may be turned on in sequence with a specified time interval. In this case, when turning on the eight light-emitting diodes 8 in sequence in clockwise or counterclockwise manner, the emitted light of each diode can be seen as if it rotates within the shade 1, thereby producing a different decorative effect or creating an aesthetic atmosphere.

The number of the light-emitting diodes 8 disposed on the base plate 6 is not limited to eight. Various number such as 16 of the light-emitting diodes may be employed in the same manner as that of the fourth embodiment. However, it is preferable to dispose 8 to 12 diodes with substantially equal spacing in order to more clearly or effectively show a light appearance, which is seen as if it converges to a point when seen through the shade.

The inside structure of the shade holding body 4 is also not limited to the foregoing embodiments.

In the foregoing embodiments, the hairlines are formed in a direction crossing at right angle to the axial direction of the shade 1 or the direction along which the light flux is transmitted. However, the crossing angle of the hairlines to the axis of the shade 1 is not limited to the right angle in those embodiments. A varying angle approximate to the right angle, such as 80–100 degrees may be employed, although crossing at right angle enhances an effect of the light appearance which can be seen as if it converges to a point.

The lighting equipment of the sixth embodiment is of a two light type with the two shades 1 disposed at the lateral sides. However, the number of the shades 1 are not limited to this embodiment, and therefore three or more shades may be arranged in the lighting equipment.

The decorative lighting equipment of the foregoing embodiments has been described by taking for example the case where it is used in a room. However, the lighting equipment of the present invention may be used outside of a building such as a porch lamp.

The decorative lighting equipment of the present invention is designed mainly to be used in conjunction with a light-emitting diode as a light source. However, other types of a light source may be employed, provided that it can emit a directional light. The light source emitting a directional light hereinbefore meant is a light source, which emits a light, which tends to advance in a specified direction, and therefore is not meant as a light source such as a fluorescent light and incandescent lamp, which lights up a relatively large area around the light source with a light having no specific or high directivity.

Also, the decorative light equipment of the present invention is not necessarily limited to a table light as described in the foregoing embodiments. Wall light, ceiling light or any other type of the lighting equipment may be employed.

This specification is by no means intended to restrict the present invention to the preferred embodiments set forth therein. Various modifications to the decorative lighting equipment of the present invention, as described herein, may be made by those skilled in the art without departing from the spirit and scope of the present invention as defined in the appended claims.

What is claimed is:

1. A decorative lighting equipment comprising a shade that is transparent or translucent and formed into a tube with opposite ends, a light source for emitting a directional light flux, said light source being placed at one end of said opposite ends of the shade so that said directional light flux is transmitted within said shade toward another end of said shade, and said shade forming thereon hairlines which extend across the direction along which said directional light flux emitted from said light source is transmitted.

2. A decorative lighting equipment according to claim 1, wherein said light source comprises a light-emitting diode.

3. A decorative lighting equipment according to claim 1, wherein said light source comprises a plurality of light-emitting diodes, which are respectively placed in said shade closer to said one end thereof in a circular fashion.

4. A decorative lighting equipment according to claim 3, wherein said plurality of light-emitting diodes are respectively placed at 8–12 points in a circular fashion.

5. A decorative lighting equipment according to claim 3, wherein said plurality of light-emitting diodes are respectively placed at 8 points in a circular fashion.

6. A decorative lighting equipment according to claim 3, wherein a base plate is mounted to said one end of the shade, and said plurality of light-emitting diodes are placed on an inwardly facing side of the base plate along a peripheral edge of said base plate.

7. A decorative lighting equipment according to claim 1, wherein said shade is formed into a circular tube.

8. A decorative lighting equipment according to claim 1, wherein said hairlines are formed on said shade in a direction crossing at right angle to said direction along which said directional light flux emitted from said light source is transmitted.

9. A decorative lighting equipment according to claim 1, wherein said hairlines are formed on an outwardly facing surface of said shade in a circumferential direction thereof, so that said light flux emitted from said light source is transmitted in a direction crossing at right angle to said hairlines.

10. A decorative lighting equipment according to claim 1, wherein said shade is placed in a vertical orientation, and said directional light flux is transmitted upwards from a lower side of the shade.

11. A decorative lighting equipment according to claim 1, wherein said shade is placed in a horizontal orientation, and light-emitting diodes are respectively disposed at opposite ends of said shade, in which said light-emitting diodes at the opposite ends respectively emit light fluxes in different colors.

* * * * *